US005687422A

United States Patent [19]

Wurst et al.

[11] Patent Number: 5,687,422

[45] Date of Patent: Nov. 18, 1997

[54] KNEE PADS FOR SPORTS USE

[76] Inventors: Patrick E. Wurst, 3118-B Crepe Myrtle Ct.; Samuel S. Klement, 509 N. Westover Blvd., No. 1432, both of Albany, Ga. 31707

[21] Appl. No.: 600,516

[22] Filed: Feb. 13, 1996

[51] Int. Cl.[6] ..... A41D 13/06

[52] U.S. Cl. ..... 2/24; 108/43

[58] Field of Search ..... 2/22, 24, 16, 2; 108/43

[56] References Cited

U.S. PATENT DOCUMENTS

| | | | |
|---|---|---|---|
| 2,701,173 | 2/1955 | Senior et al. | 108/43 |
| 4,575,964 | 3/1986 | Griffin . | |
| 4,864,698 | 9/1989 | Brame . | |
| 5,018,294 | 5/1991 | McGuffee . | |
| 5,077,837 | 1/1992 | Meistrell | 2/22 X |
| 5,135,473 | 8/1992 | Epler | 2/22 X |
| 5,220,691 | 6/1993 | Wiegers | 2/22 X |
| 5,255,391 | 10/1993 | Levine . | |
| 5,301,370 | 4/1994 | Henson | 2/22 |
| 5,307,521 | 5/1994 | Davis | 2/22 |
| 5,350,776 | 9/1994 | Raad . | |
| 5,423,087 | 6/1995 | Krent et al. | 2/267 X |
| 5,497,511 | 3/1996 | Zade | 2/22 |

FOREIGN PATENT DOCUMENTS 2277431 2/1994 United Kingdom .

*Primary Examiner*—Paul C. Lewis

*Attorney, Agent, or Firm*—Hinkle & Associates P.C.

[57] ABSTRACT

A knee guard (10) is a substantially elongated rectangular foam member (14) that has a protuberance disposed thereon. That protuberance is formed as a matter of convenience into a V-shape (16). Knee guard (10) has an elongated flexible sheet foldable across its width and covering elongated foam member (14) and V-shaped protuberance (16*a* and 16*b*). The sheet (18) has perimeter edges sewn together thereby securing foam member (14) within the folded sheet. A strap (20) is connectively disposed onto sheet (18) thereby retaining knee guard (10) about the knee of an intended user.

2 Claims, 2 Drawing Sheets

KNEE PADS FOR SPORTS USE

BACKGROUND OF THE INVENTION

I. Field of the Invention

The present invention relates generally to the field of an apparatus for protecting the knee of an intended user and to steady a hand-held piece of sports equipment. In particular the invention is directed to an apparatus worn about the intended user's knee that is light weight and easily applied to the user's knee or thigh. The invention is more particularly directed to an apparatus that conforms to a user's knee or thigh area and also provides a resting place for a telescopic lens, firearm or camera equipment.

II. Description of the Related Art

Sports Enthusiasts that enjoy the out-of-doors are involved in a multiplicity of endeavors such as photographing, hunting, or bird watching. Those sports enthusiasts spend a great deal of their time in a sitting or sedentary position with perhaps a telescopic lens of a camera or a barrel of a rifle resting across one or both legs or knees in preparation for their chosen activity. Frequently, the sports enthusiast, to relieve pressure caused by the weight of the lens or barrel on the leg or knee, will move or reposition that lens or rifle. That movement may cause a disturbance in the adjacent vicinity thereby alerting the wildlife to their presence.

To relieve pressure to the knee area and maintain the stealth of their endeavor, a knee guard may be used. Most knee guards require the user to buckle, snap, or lace the guard to their leg or knee. Those knee guards generally do not have a support for any external objects positioned on the knee guard such as the telescopic lens or the barrel of the rifle.

There have been many attempts in the past to resolve this problem of orthopedic pressure in the knee area due to the weight of an external object. One such attempt is U.S. Pat. No. 5,255,391 to Levine. Levine discloses a guard for the knee of the intended user that is concave in shape to fit the user's knee. Levine's knee guard comprises a resilient cushion and straps to securely retain the knee guard to the user's leg. Levine does not disclose a knee guard that provides the user a means of supporting any external objects positioned on the knee guard.

The United Kingdom Patent No. 02277431 to Krejov discloses a knee guard that comprises a plastic shell that is hard enough to keep its shape but soft enough not to damage the user's knee. That knee guard merely conforms to the shape of the user's knee and does not allow for the positioning of any external objects to the face of the knee guard.

U.S. Pat. No. 4,575,964 to Griffin discloses a gun rest that comprises a pair of oppositely directed U-shaped members positioned at opposite ends of an elongated support assembly. One of the U-shaped members is sized to fit over the user's thigh in the vicinity of the knee. The other U-shaped member is sized to fit an external object. Griffin suffers from the same dilemma as others in the art field. Griffin does not provide any support for protecting the user's knee during long periods of inactivity while resting a barrel or lens in proximity to the user's knee.

Accordingly there is a need for a knee or leg guard that is easily applied to the intended user's knee or leg. The knee guard will also provide a means for positioning an external object thereon.

SUMMARY OF THE INVENTION

In accordance with the present invention, it is contemplated that in light of the problems that exist in this field, objectives of the invention are to provide a knee guard apparatus which:

Provides protection to the knee of the intended user;

Is apparatus for positioning or guiding an external object;

Is producible in various sizes and is easily attached to the intended user's knee;

Is inexpensive to produce and long lasting for public availability; and

Is convenient and reliable for the intended user while engaging in the chosen activity.

The present invention accomplishes the above and other objectives with a knee guard. That knee guard is detachably secured and adjacently spaced from the centered portion of the knee of the intended user. The knee guard has an outwardly projecting protuberance that is conformable to any external object positioned thereon. The outwardly projecting protuberance serves to position and guide the external object's place on the knee guard.

The knee guard may, if desired, be fabricated from a compressible or resilient material that is substantially rectangular in shape. That knee guard has a top surface and a bottom surface and is conformable about the knee of the intended user. The outwardly projecting protuberance may, if desired, be a substantially V-shaped member disposed on that top surface of the knee guard with the apex of the V-shape member facing away from the intended user. For convenience of the user the apex of the V-shaped member may be facing towards the intended user. A flexible sheet-like material that is foldable across its width is disposed about and covering the top and bottom surfaces of the knee guard and the V-shaped member. The sheet has perimeter edges that are sewn together thereby securing the knee guard and V-shaped member within the folded sheet.

The folded sheet has a strap that secures the present invention to the knee of the intended user. That strap may, if desired, be detachably secured in its approximate center portion. The detachably secured strap allows easy fitting or connecting of the strap thereby facilitating the fastening and unfastening of the strap.

At least one pocket may, if desired, be attached to the surface of the sheet for storing any desired contents. This pocket may, if desired be fabricated from an elastic like material thereby conforming to the shape of the contents of the pocket.

Other objects, advantages and capabilities of the invention will become apparent from the following description taken in conjunction with the accompanying drawings showing preferred embodiments of the invention.

DESCRIPTION OF THE PREFERRED EMBODIMENTS

Figure 1:
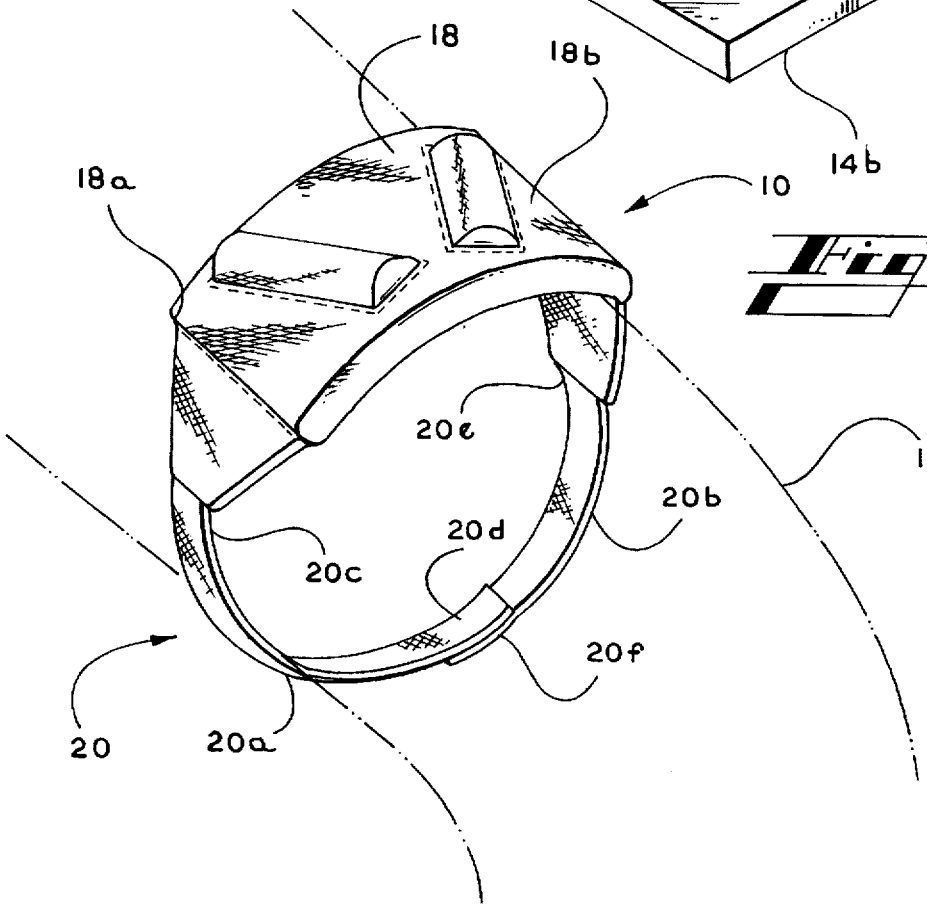
FIG. 1 is perspective view of the preferred embodiment of the knee guard.

Referring to the drawings wherein like reference numerals designate corresponding parts throughout the several figures of the drawings, the knee guard is generally illustrated at 10 of FIG. 1. Knee guard 10 is generally positioned between the upper portion of the thigh and the knee cap of the intended user. Knee guard 10, for illustration purposes only, is adjacently positioned from knee 12 of the intended user as illustrated in FIG. 1.

Figure 5:
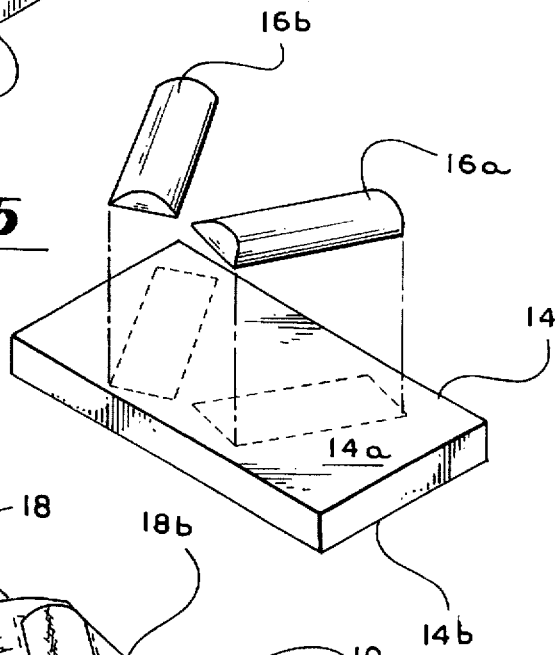
FIG. 5 is an exploded view of FIG. 4.

Knee guard 10 is fabricated from a resilient member 14, FIG. 5, that allows the user to conform or size knee guard 10 about knee 12 of the user. Resilient member 14 is compressible and may, if desired, be composed of elastic foam, pliable plastic, jell-like material, or any other convenient material well known in the art field that will allow resilient member 14 to conform to knee 12.

Figure 4:
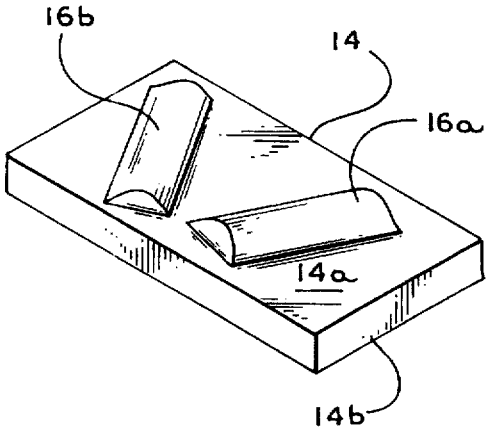
FIG. 4 is a perspective view of a resilient member with an attached V-shaped member.

Resilient member 14 has a substantially elongated or rectangular shape and has a top surface 14*a* and a bottom surface 14*b*. A pair of substantially elongated semi-circular members 16*a* and 16*b*, as seen in FIG. 5, are preferably adjacently spaced to approximate a V-shape 16. That V-shape member is a matter of convenience and may, if desired, be any protuberance projecting outwardly from resilient member 14. The shape may take any convenient form that allows the placement of an external object (not shown) such as a telescopic lens of a camera or a barrel of a rifle into the confines of the shape. Elongated members 16*a* and 16*b* are connected to top surface 14*a* of resilient member 14 in any convenient manner. An example of that connecting technique would be to use a glue or a form of heat treatment that allows permanent attachment of elongated members 16*a* and 16*b* to top surface 14*a* of resilient member 14 as illustrated in FIG. 4. Those elongated members 16*a* and 16*b* are preferably fabricated from rigid material but as a matter of convenience may be fabricated from the same or different material as resilient member 14.

An elongated flexible sheet, or covering, 18 is foldable across its width and covers top surface 14*a*, bottom surface 14*b*, and elongated members 16*a* and 16*b*. Sheet 18 is fabricated from any suitable material known in the art for flexibility, durability and strength. Sheet 18 is preferably a camouflage color to blend in with the out-of-doors environment but may, if desired, be any color that lends itself to an out-of-doors environment. Sheet 18 has perimeter edges that are sewn together thereby securing resilient member 14 and elongated members 16*a* and 16*b* within the fold of sheet 18. Sheet 18 has a first end 18*a* and an oppositely space second end 18*b*. Sheet 18 has preferably a strap 20 connecting first end 18*a* to second end 18*b* for retaining knee guard 10 about knee 12 of the user.

Figure 3:
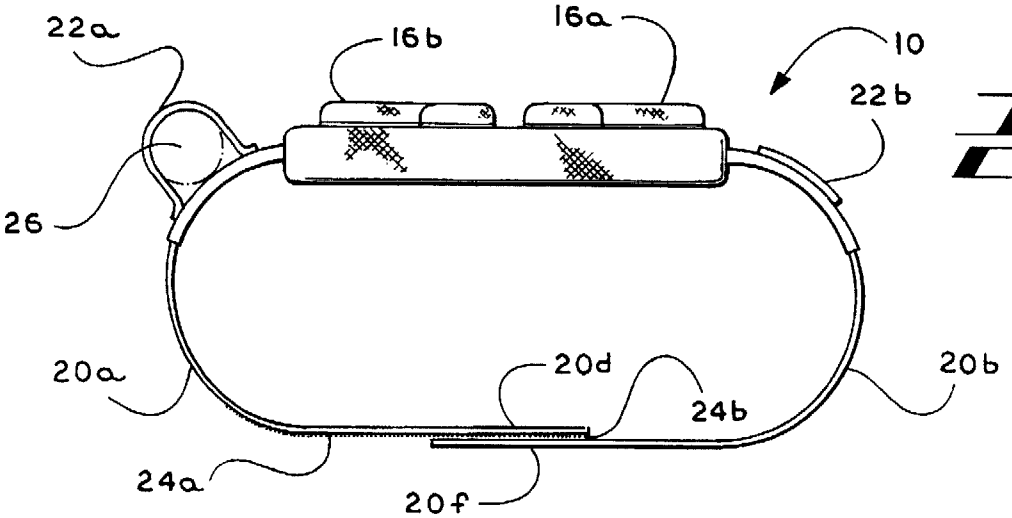
FIG. 3 is a side view of the FIG. 1.

Strap 20 may, if desired, be fabricated from an elongated elastic material that will retain knee guard 10 to the leg of the user. Strap 20 may also be fabricated from a pair of elongated straps 20*a* and 20*b*. Elongated strap 20*a* has a first end 20*c* connected to the first end 18*a* of sheet 18. Strap 20*a* has a second end 20*d* oppositely spaced from first end 20*c*. A second end 20*d* has one half of a hook and loop fastener 24*a*, as seen in FIG. 3, connected thereto. Strap 20*b* has one end 20*e* connected to second end 18*b* of sheet 18. Strap 20*b* has a second end 20*f* oppositely spaced from its first end 20*e*. The second end 20*f* has one half of a hook and loop fastener 24*b*, FIG. 3, connected thereto, thereby strap 20*a* and strap 20*b* are detachably fastened or secured together.

Figure 2:
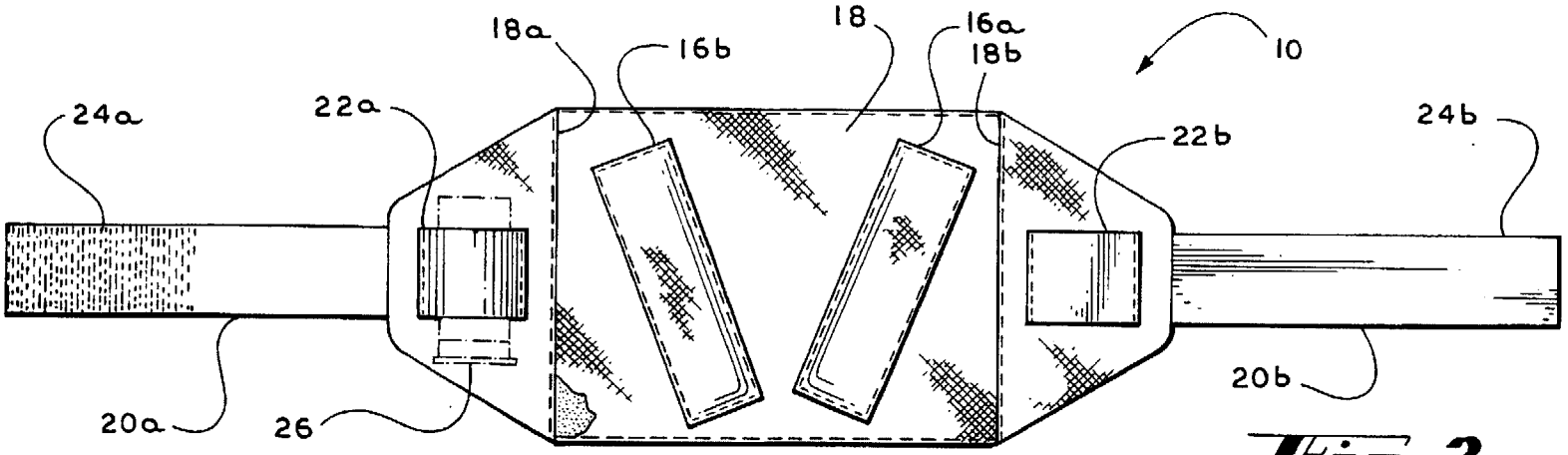
FIG. 2 is a top view of the FIG. 1.

As seen in FIG. 3, knee guard 10 has preferably at least one elastic pocket 22*a* disposed thereon but a plurality of pockets may, if desired, be connected to knee guard 10. FIG. 3 illustrates pocket 22*a* and pocket 22*b* connected to the top surface of sheet 18. Pockets 22*a* or 22*b* may be positioned in any convenient place on knee guard 10. Pocket 22*a* and 22*b* are fabricated from a substantially elastic material that will conform to the shape of the pocket's contents. An example of pocket 22*a* conforming to its contents is illustrated in FIG. 2 wherein pocket 22*a* is conforming about a shot gun shell 26. FIG. 2 and FIG. 3 illustrate pocket 22*b* without any contents. Various modifications may be made of the invention without departing from the scope thereof and it is desired, therefore, that only such limitations shall be placed thereon as are imposed by the prior art and which are set forth in the appended claims.

What is claimed is:

1. A knee guard, comprising:

a substantially elongated rectangular foam member having a top surface and a bottom surface, a pair of substantially elongated semi-circular foam members adjacently spaced and connected to the top surface of the substantially elongated rectangular foam member, an elongated flexible sheet covering the top and bottom surfaces of the substantially elongated foam member and the pair of semi-circular foam members, the sheet having perimeter edges sewn together thereby securing the substantially elongated rectangular foam member within the folded sheet, the folded sheet having a first end and an oppositely spaced second end, a first elongated strap having a first end connected to the first end of the folded sheet, the first strap having a second end oppositely spaced from its first end, the first strap's second end having one half of a hook and loop fastener connected thereto, a second elongated strap having one end connected to the second end of the folded sheet, the second strap having a second end oppositely spaced from its first end, the second strap's second end having one half of a hook and loop fastener connected thereto, at least one elastic pocket disposed on the folded sheet, and the pocket being fabricated from a substantially elastic material.

2. A knee guard as recited in claim 1, wherein the pair of substantially elongated semi-circular foam members are spaced apart to form a V-shape.

* * * * *